US006293212B1

(12) United States Patent
Ebata et al.

(10) Patent No.: US 6,293,212 B1
(45) Date of Patent: Sep. 25, 2001

(54) SEWING MACHINE WITH AN EMBROIDERY STITCHING FUNCTION

(75) Inventors: Yoshikazu Ebata; Tsutomu Takagi; Eiichi Shomura, all of Tokyo (JP)

(73) Assignee: Janome Sewing Machine Co., Ltd, Tokyo (JP)

( * ) Notice: Subject to any disclaimer, the term of this patent is extended or adjusted under 35 U.S.C. 154(b) by 0 days.

(21) Appl. No.: 09/672,588

(22) Filed: Sep. 28, 2000

(30) Foreign Application Priority Data

Oct. 5, 1999 (JP) ..... 11-284835

(51) Int. Cl.[7] ..... D05B 21/00; D05C 9/04
(52) U.S. Cl. ..... 112/103; 112/168; 112/470.18
(58) Field of Search ..... 112/103, 102.5, 112/470.06, 168, 470.14, 470.18

(56) References Cited

U.S. PATENT DOCUMENTS 5,040,476 * 8/1991 Takenoya et al. ..... 112/453 X
5,868,088 * 2/1999 Mori et al. ..... 112/102.5
6,019,052 * 2/2000 Stucki et al. ..... 112/102.5
6,158,365 * 12/2000 Hidechika et al. ..... 112/103

* cited by examiner

*Primary Examiner*—Peter Nerbun
(74) *Attorney, Agent, or Firm*—Nields & Lemack

(57) ABSTRACT

A sewing machine with an embroidery stitching function is disclosed, wherein a needle is vertically reciprocated to form stitches on a work held by an embroidering frame (19) which is moved in X-Y directions by a frame moving device relative to the needle on a working surface (2*a*) of a working bed (2), the frame moving device being composed of composed of a first mechanism (A) for moving said embroidering frame in the Y direction and a second mechanism (B) for moving the embroidering frame in the X direction, the first mechanism (A) being located on the working surface and connected to the embroidering frame (19) and the second mechanism (B) being housed in the sewing machine, the first mechanism (A) being moved by the second mechanism (B) to one end of the working bed (2) where the first mechanism (A) is rotated to a retreated position at the time of carrying out the ordinary stitching operation.

12 Claims, 8 Drawing Sheets

SEWING MACHINE WITH AN EMBROIDERY STITCHING FUNCTION

BACKGROUND OF THE INVENTION AND RELATED ART

The present invention relates to a sewing machine with an embroidery stitching function, and more particularly relates to a sewing machine which may be switched easily and promptly between a mode for carrying out the ordinary stitching operation and a mode for carrying out the embroidery stitching operations without removing an embroidery stitching device including the means for moving an embroidering frame from the sewing machine.

It has been a long time since the sewing machine with an embroidery stitching function went into general use. This type of sewing machine is provided with a mechanism for moving an embroidering frame. As the mechanism for moving an embroidering frame, it is generally known that the mechanism is normally housed entirely in a base portion of the sewing machine with a portion for holding an embroidering frame being extended out from a side of the base portion such that the embroidering frame moving mechanism may not be an obstacle in case the ordinary stitching operation is carried out.

However, since there are a limitation of space for entirely housing the embroidering frame moving mechanism and a limitation of distance that the mechanism is moved into the space for housing the same, there has been proposed an embroidering frame moving mechanism which is partly or entirely exposed on the working bed of sewing machine.

As to the typical type of sewing machine, one of the two structures composing the embroidering frame moving mechanism is housed within the sewing machine and the other is provided on the working bed of sewing machine such that the two structures may be operated to move the embroidering frame in the X-Y directions.

Since the other of the two structures is extended up from the working surface of the sewing machine, in case the ordinary stitching operation is carried out, the embroidering frame is removed from the structure and then the structure is designed to be removed from the sewing machine.

The other of the two structures is normally connected to one of the two structures by means of fastening members such as fastening screws or other specific connectors. It is, therefore, rather difficult and troublesome to remove the structure from the sewing machine and to attach the same again to the sewing machine. In case the ordinary stitching operation and the embroidering operation are required alternately so often, the user is required to take such difficult and trouble some work every time. Moreover, it will often happen that the fastening screws are lost.

According to the sewing machine with an embroidery stitching function of the invention, the sewing machine is provided with a device for moving the embroidering frame, the device being located on a working surface of a working bed of sewing machine at the time of carrying out the embroidery stitching operation and a device for retreating the embroidering frame moving device from the working surface of the working bed to an inoperative position at the time of carrying out the ordinary stitching operation. The inoperative position or retreated position is typically preferable to be designated to a side of the working bed. The embroidering frame moving device, however, may be retreated down to a position where the device is located below the level of the working surface.

According to a preferred embodiment of the invention, the embroidering frame moving device may be operated to retreat from the working surface of working bed to a side of working bed along a curved surface extending between a part of the working surface and a side of the working bed.

At the time of retreating the embroidering frame moving device from the working surface to the side of working bed, the embroidering frame is normally removed from the embroidering frame moving device. The device, however, may be retreated while the embroidering frame is attached to the device.

In case the embroidering frame moving device is retreated from the upper surface of working bed to a side of working bed, it is preferable to rotate the device by 90°. In case the device is retreated with the embroidering frame being attached to the device, only the embroidering frame may be further rotated by 90°.

The embroidering frame moving device normally includes an X-direction moving mechanism and a Y-direction moving mechanism, and one of the two mechanisms is housed within a sewing machine while the other of the two mechanisms is normally located on the working bed of sewing machine.

In case the working bed is formed with a free arm and an auxiliary table which is removably attached to the free arm so as to provide a working surface with a working surface of the free arm and a working surface of the auxiliary table, it is preferable that the embroidering frame moving device and the retreating device are provided on the auxiliary table.

The embroidering frame moving device may be designed to be automatically retreated to the inoperative position at the time of changing a mode from the embroidering operation to the ordinary stitching operation.

According to a preferred embodiment of the invention, the retreating device is connected to one of the X- and Y-direction moving mechanisms of the embroidering frame moving device, and the one of the X- and Y-direction moving mechanisms is moved to one end of the working bed by the other of the X- and Y-direction moving mechanisms. Subsequently the one of the X- and Y-direction moving mechanisms is rotated by 90° to retreat from the working surface to the side of working bed.

BRIEF DESCRIPTION OF THE ATTACHED DRAWINGS

DETAILED DESCRIPTION OF THE PREFERRED EMBODIMENTS OF THE INVENTION

The invention will now be described in reference to the preferred embodiments as shown in the attached drawings.

Figure 1A:
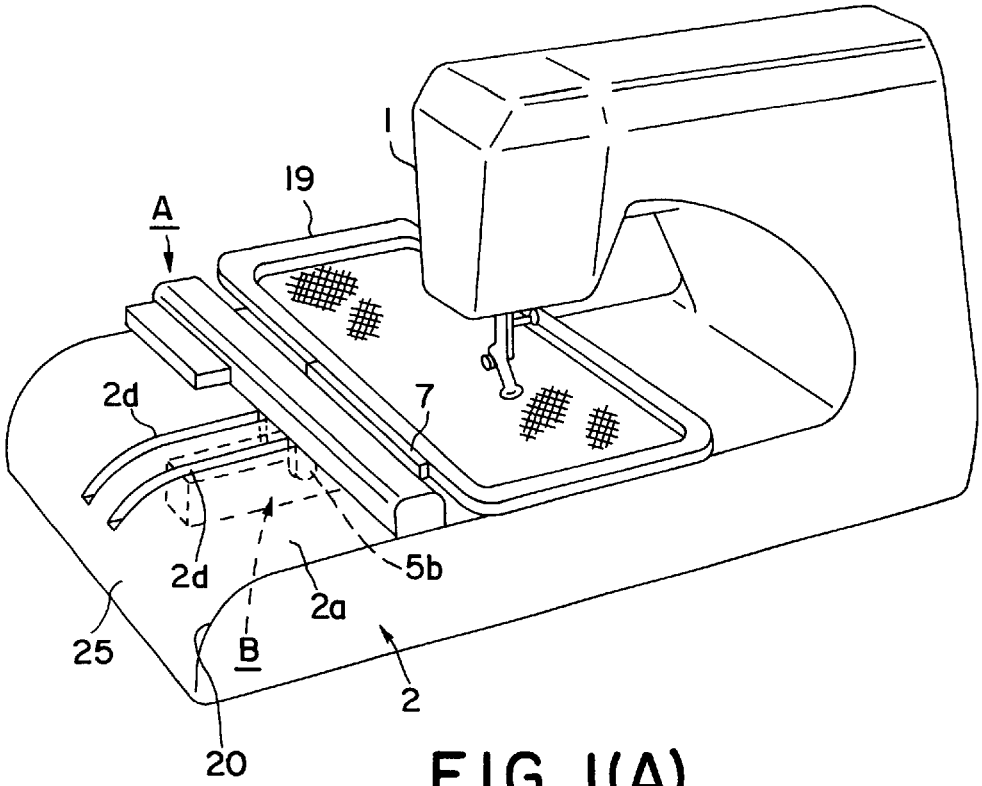
FIG. 1(A) is a perspective view of the sewing machine according to the invention diagrammatically showing a condition for carrying out the embroidering operation.
Figure 1B:
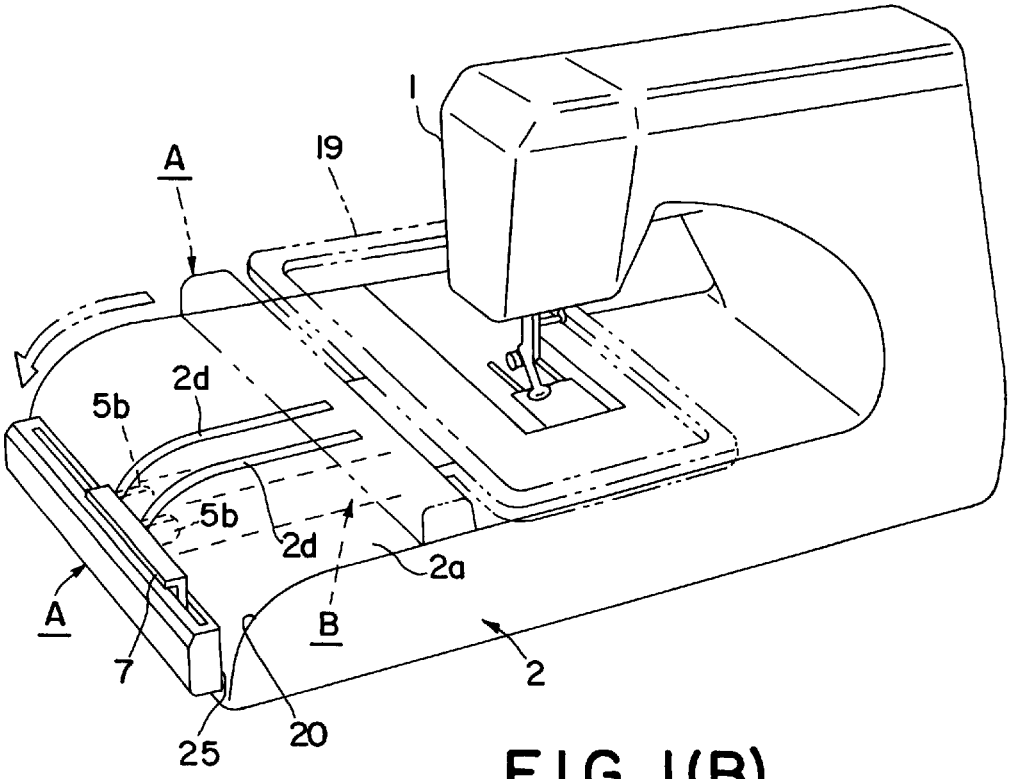
FIG. 1(B) is a perspective view of the sewing machine according to the invention diagrammatically showing a condition for carrying out the ordinary stitching operation, wherein an embroidering frame carriage is retreated to an inoperative position.
Figure 2A:
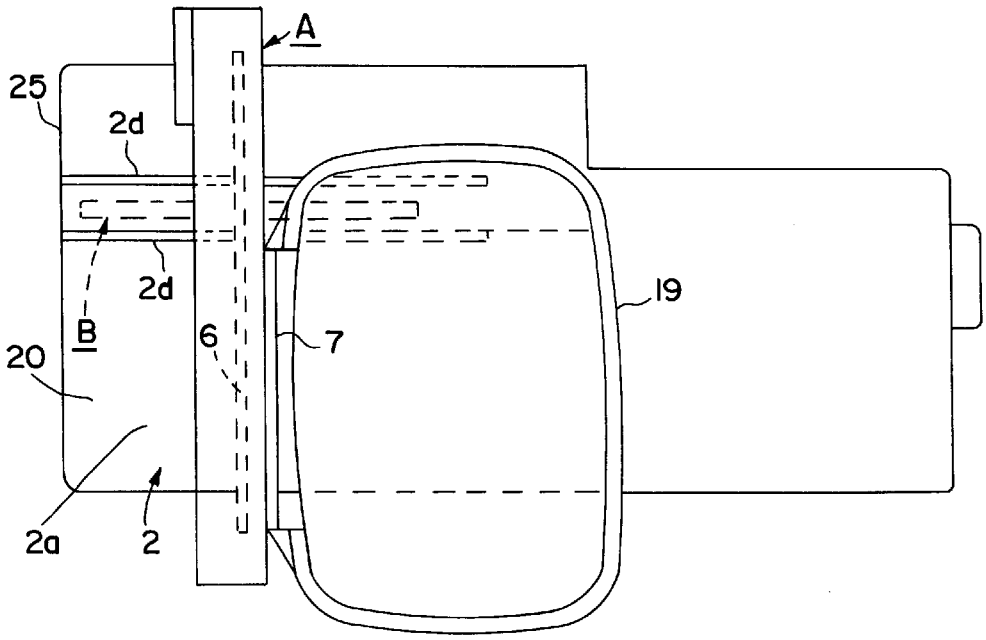
FIG. 2(A) is a plan elevational view of the essential parts of sewing machine diagrammatically showing a condition for carrying out the embroidering operation in an enlarged scale.
Figure 2B:
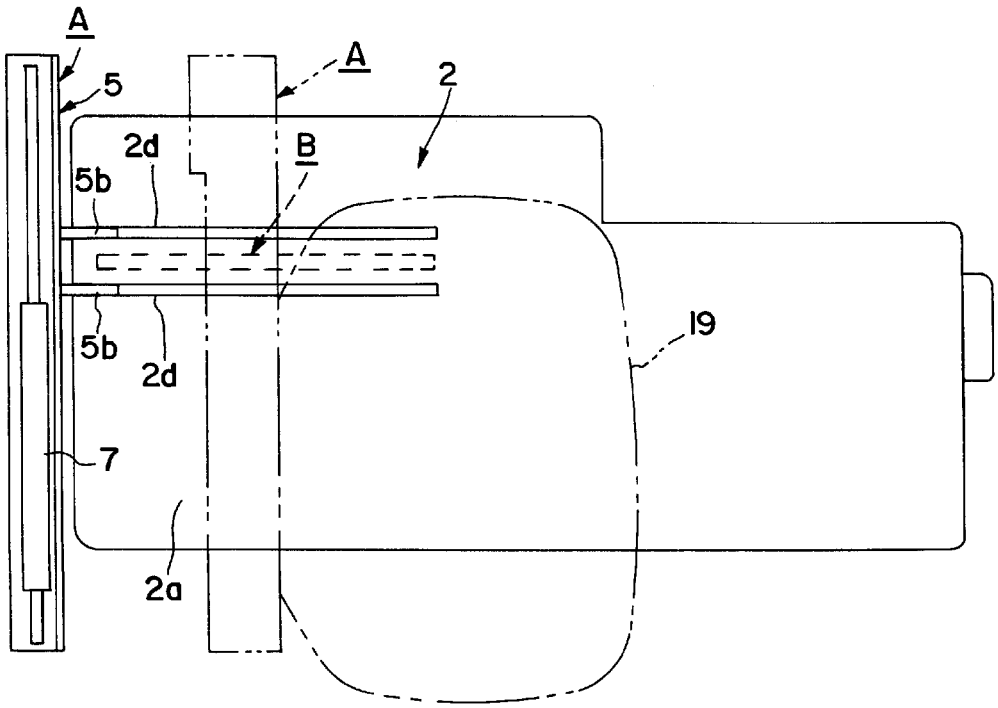
FIG. 2(B) is a plan elevational view of the essential parts of sewing machine diagrammatically showing a condition in an enlarged scale, wherein the embroidering frame carriage is retreated to an inoperative position.
Figure 3A:
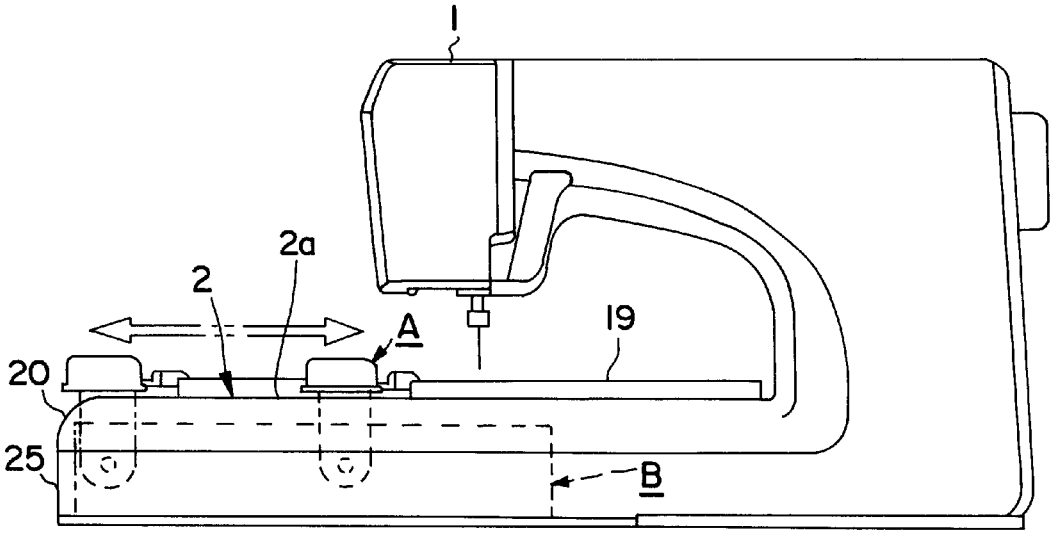
FIG. 3(A) is a side elevational view of the sewing machine according to the invention diagrammatically showing a condition for carrying out the ordinary stitching operation.
Figure 3B:
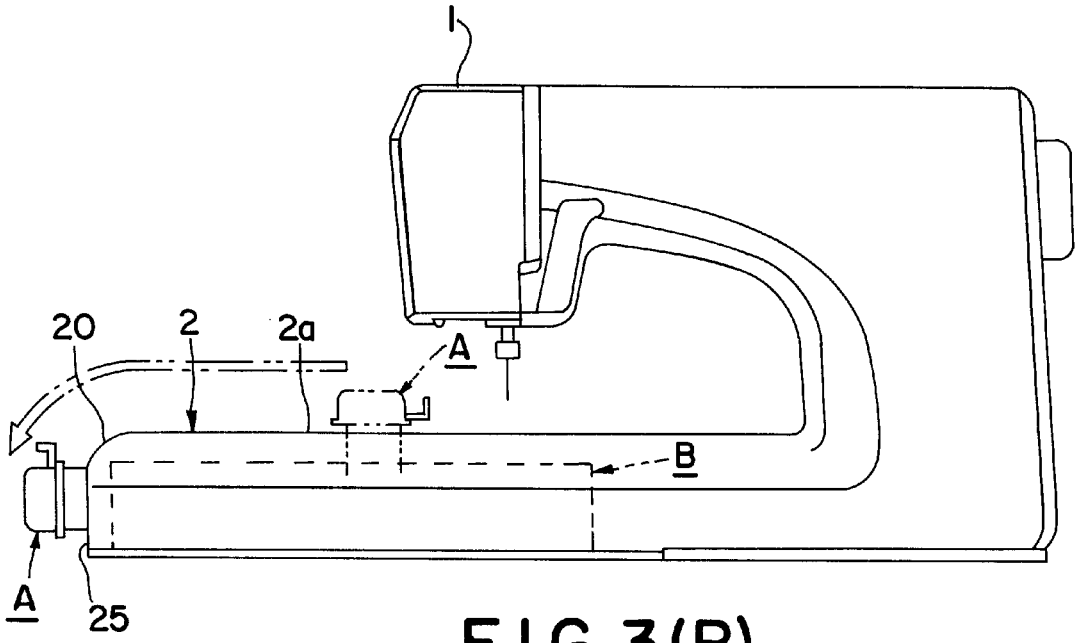
FIG. 3(B) is a side elevational view of the sewing machine according to the invention diagrammatically showing a condition, wherein the embroidering frame carriage is retreated to an inoperative position.
Figure 4:
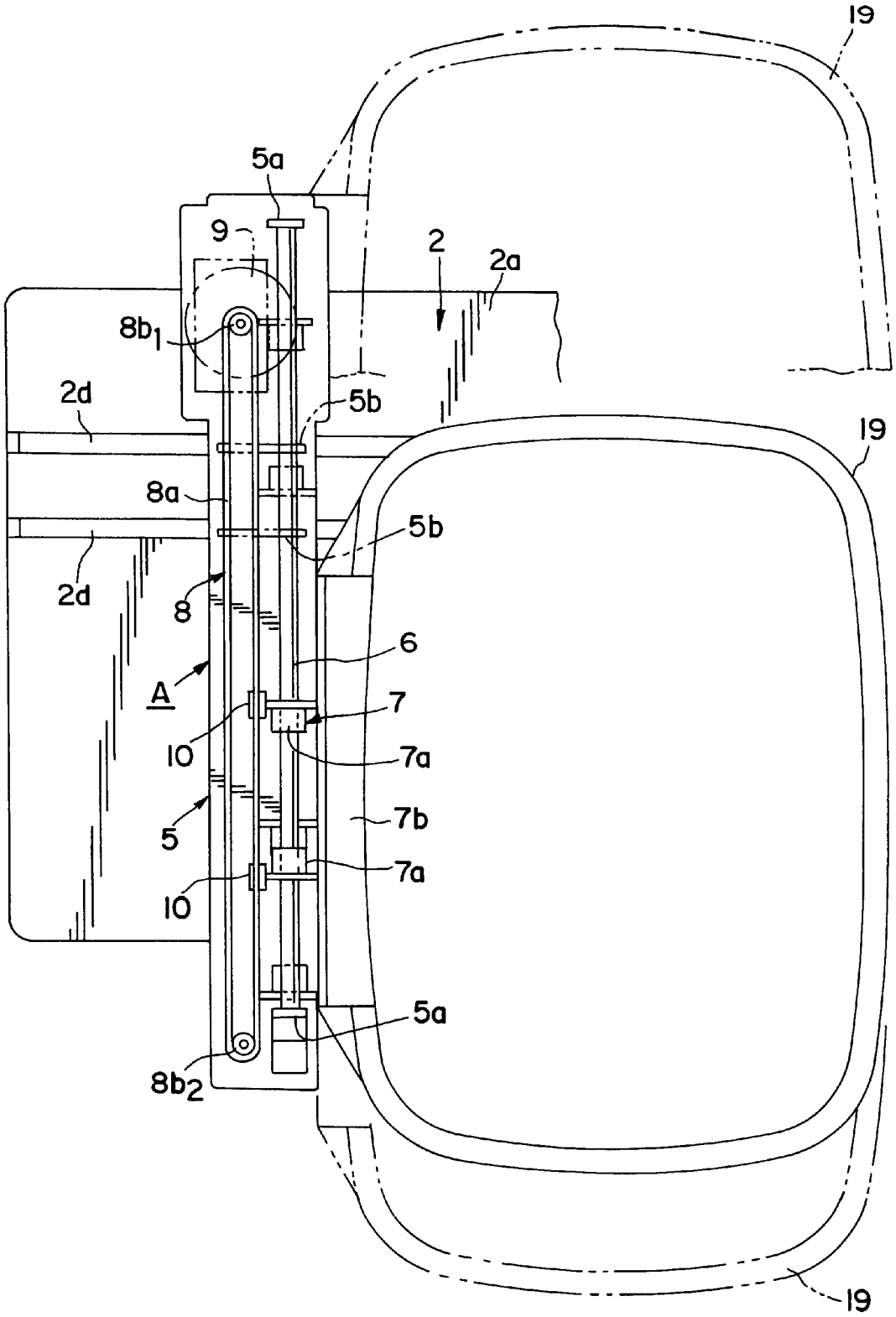
FIG. 4 is a plan elevational view of the essential parts in the embroidering frame carriage diagrammatically shown in an enlarged scale.

As to a first embodiment, FIGS. 1(A) and 1(B) show perspective views of the sewing machine of the invention in the embroidering mode and ordinary stitching mode respectively. FIGS. 2(A) and 2(B) show perspective views of the essential parts of sewing machine of the invention in the embroidering mode and ordinary stitching mode respectively. FIGS. 3(A) and 3(B) show side elevational views of the of sewing machine of the invention in the embroidering mode and ordinary stitching mode respectively. The sewing machine is mainly composed of a arm 1 and a working bed 2 as is usual with the ordinary sewing machine. In the arm 1, there are housed a drive shaft and a needle bar having a needle attached thereto and vertically reciprocated in association with rotation of the drive shaft.

The working bed 2 has an upper working surface 2*a* which is used for the ordinary stitching operation and for the embroidering operation. The working surface 2*a* has a throat plate and others as usual with the ordinary sewing machine. A Y-direction moving mechanism A is located on the working surface 2*a* and may be slidingly moved in the X-direction. In the working bed 2, there is housed an X-direction moving mechanism B for drivingly moving the Y-direction moving mechanism A in the X-direction (FIGS. 5(A) and 5(B)). The X-direction moving mechanism B has a retreating device incorporated therein for retreating the Y-direction moving mechanism A to a side of the working bed 2.

The Y-direction moving mechanism A may be moved in the X-direction (width-direction) on the working surface 2*a* while a carriage 7 mounted to the Y-direction moving mechanism A may be moved in the Y-direction (depth-direction) on the Y-direction moving mechanism A. An embroidering frame 19 is attached to the carriage 7 so as to be moved in the X- and Y-directions for the embroidering operation.

In case the embroidering operation is not selected, the Y-direction moving mechanism A may be retreated to an inoperative position so as not to be an obstacle to the ordinary stitching operation. According to the embodiment, the Y-direction moving mechanism A may be retreated to a side position 25 of the working bed 2 from the working surface 2*a*.

The Y-direction moving mechanism A may be moved in the X-direction along a pair of spaced guide grooves 2*d* formed as extending in the X-direction and opened at the working surface 2*a*. The guide grooves 2*d* are extended from the upper working surface 2*a* to the side 25 of the working bed 2 in the X-direction. The portion between the upper working surface 2*a* and the side 25 of the working bed 2 is sloped to form a smoothly curved surface 20. The Y-direction moving mechanism A may be moved along the guide grooves 2*a* and may be rotated at the curved surface 20 and retreated to the side 25 of the working bed 2.

According to the embodiment, the embroidering frame 19 is removed from the Y-direction moving mechanism A in case the Y-direction moving mechanism A is moved to the retreated position. However, the Y-direction moving mechanism A may be retreated while the embroidering frame 19 is attached to the Y-direction moving mechanism A. For example, only the embroidering frame 19 may be rotated in one direction in a horizontal plane from the position as shown in FIG. (1B).

There may be various ways for retreating the Y-direction moving mechanism A to a retreated position. In any events, it is preferred to retreat the Y-direction moving mechanism A down to a position where the Y-direction moving mechanism A is located below the working surface 2*a*.

The Y-direction moving mechanism A has a carriage base 5 and a guide rail 6 arranged therein as shown in FIG. , the guide rail being extended in the Y-direction on the carriage base 5. The carriage 7, which is composed of a pair of spaced slide members 7*a*, 7*a*, is mounted to the guide rail 6 and is slidingly movable along the guide rail 6 which is circular in vertical section and is supported at the opposite ends thereof by supports 5*a*, 5*a* arranged on the carriage base 5.

The carriage 7 is further provided with a portion 7*b* to which the embroidering frame 19 is removably attached. The pair of spaced slide members 7*a*, 7*a*, are so arranged to secure the stabilized movement of the carriage 7 and/or the embroidering frame 19 along the guide rail 6.

The carriage base 5 has a carriage driver 8 arranged thereon. The carriage driver 8 includes an endless drive belt 8*a* arranged as extended in the Y-direction adjacent to and in parallel with the guide rail 6 and is wound around a pair of oppositely spaced pulleys 8*b*1, 8*b*2 arranged on the carriage base 5.

One of the pulleys 8*b*1, 8*b*2 is connected to a drive motor 9 which is driven to move the drive belt 8*a* around the pulleys 8*b*1, 8*b*2. The drive belt 8*a* is connected to the carriage 7 by means of a pair of joints 10,10 such that the carriage 7 may be moved in association with movement of the drive belt 8*a* in the Y-direction.

The joints 10, 10 may include fastening screws, pins or [the like for fastening the drive belt 8*a* to the carriage 7. As shown in FIGS. 5(A) to 6(C), the carriage base 5 has a pair of arms 5*b*, 5*b* each of which has an upper end secured to the bottom of the carriage base 5 and is vertically extended below. The arms 5*b*, 5*b* are rotatably connected to a slide member 11 of the X-direction moving mechanism B which will be described in detail hereinlater.

As particularly shown in FIGS. 5(A) to 6(C), the X-direction moving mechanism B is substantially composed of the slide member 11, a guide rail 12 arranged on a base 16 extended in the X-direction and a belt driver 13 including an endless drive belt 13*a* arranged on the base 16*c* and extended in the X-direction in parallel with the guide rail 12 and wound around a pair of oppositely spaced pulleys 13*b*1, 13*b*2 arranged on the base 16.

One of the pulleys 13*b*1, 13*b*2 is connected to a drive motor 14 which is driven to move the drive belt 13*a* in the X-direction around the pulleys 13*b*1, 13*b*2. The drive belt 13*a* is connected to the slide member 11 by means of a joint 15 such that the slide member 11 may be moved in the X-direction in association with movement of the drive belt 13*a* (FIG. 5(A)). The joint 15 may include a fastening screw, a pin or the like just as the joints 10, 10 for fastening the drive belt 13*a* to the slide member.

The guide rail 12 is supported on a pair of oppositely spaced supports 12*a*, 12*a* arranged at the opposite ends of the base 16. The slide member 11 is of a reversed U-shape in vertical section and composed of a top wall 11*a* and side walls 11*b*, 11*b* extended down from the opposite sides of the top wall 11*a* which are extended in the X-direction. One of the opposite side walls 11*b*, 11*b* has a guide portion 11*c* formed thereat as axially extended in the X-direction. The guide portion 11*c* has a guide hole through which the guide rail 12 extends such that the slide member 11 may be slidingly moved in the X-direction along the guide rail 12.

Figure 6A:
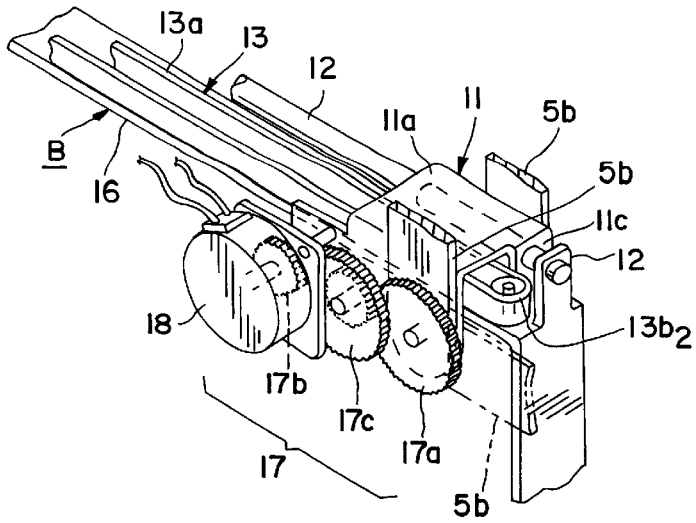
FIG. 6(A) is a perspective view of the essential parts of carriage driver of the invention.
Figure 6B:
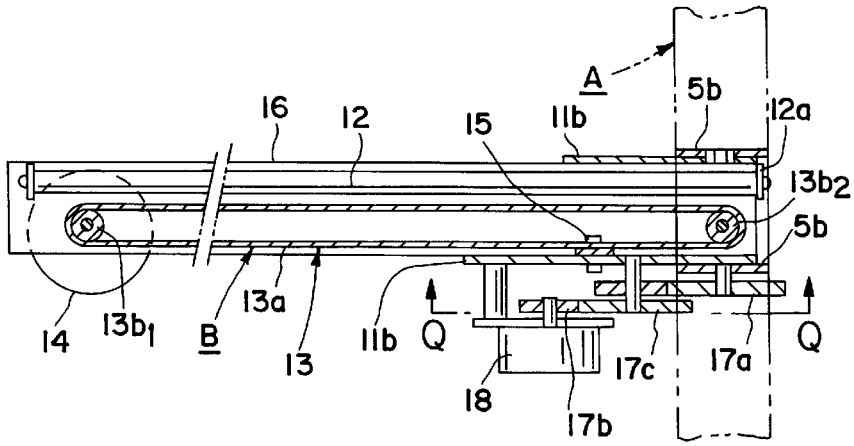
FIG. 6(B) is a is a plan elevational view of the carriage driver shown partly in section.

As shown in FIGS. 6(A)and 6(B), the arms 5*b*, 5*b* of the carriage base 5 have lower ends respectively pivotally connected to the opposite side walls 11*b*, 11*b* of the slide member 11 on both sides thereof such that the slide member 11 may be rotated around the pivot axes. A gear mechanism 17 and a drive motor 18 are provided on the side of the other of the opposite side walls 11*b*, 11*b* of the slide member 11.

Figure 6C:
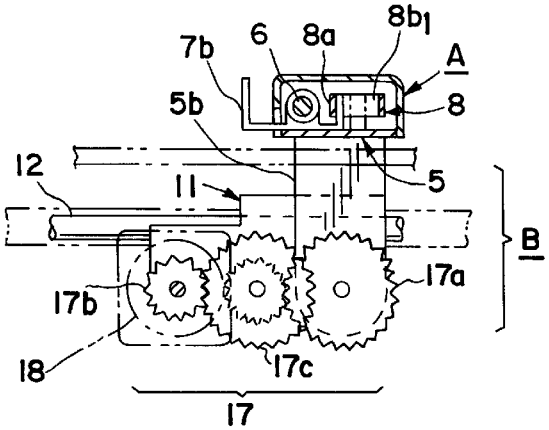
FIG. 6(C) is a is a side elevational view of FIG. 6(B) taken along the line Q—Q.

As shown in FIGS. 6(A) to 6(C), the gear mechanism 17 is composed of a first gear 17*a* secured to one of the opposite arms 5*b*, 5*b* of the carriage base 5 and a second gear 17*c* rotatably mounted to the other of the opposite side walls 11*b*, 11*b* of the slide member 11. The second gear 17*c* is mounted to the other of the opposite side walls 11*b*, lib of the slide member 11 and has a pinion coaxially fixed thereto and being in mesh with the first gear 17*a*. The drive motor 18 has a drive shaft having a pinion 17*b* secured thereto and being in mesh with the second gear 17*c*.

Figure 5A:
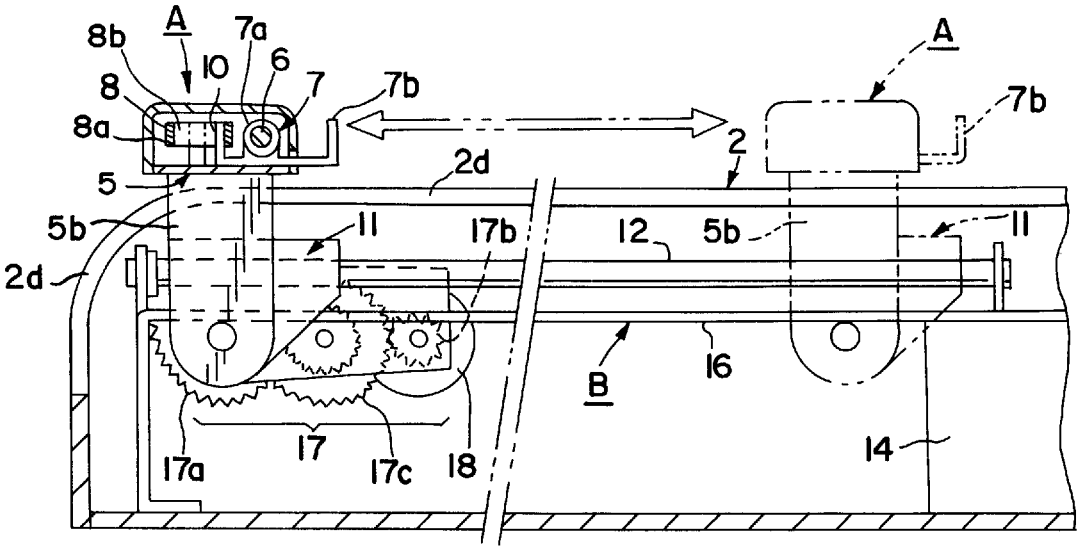
FIG. 5(A) is a side elevational view of the essential parts of sewing machine diagrammatically showing in an enlarged scale and in partly in vertical section a mode of movement of the embroidering frame carriage on the working surface.
Figure 5B:
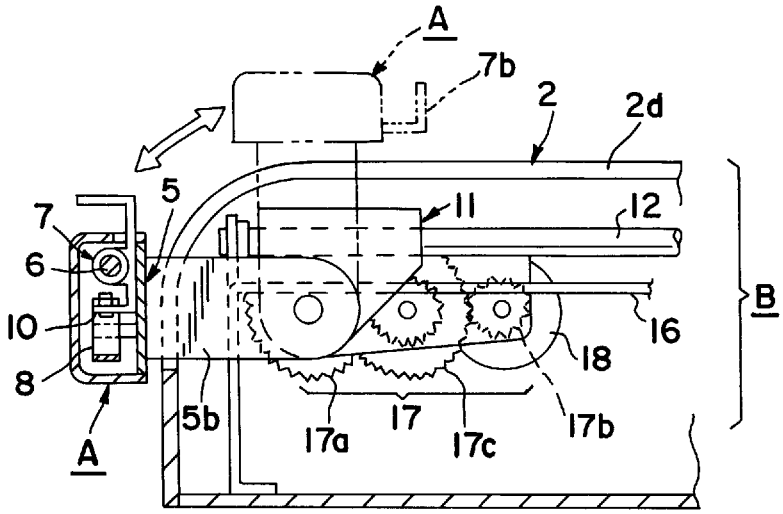
FIG. 5(B) is a side elevational view of the essential parts of sewing machine diagrammatically showing in an enlarged scale and in partly in vertical section a mode of rotation of the embroidering frame carriage from the operative position to the inoperative position.

With the drive motor 18 being driven, the Y-direction moving mechanism A is rotated through the gear mechanism 17 between an operative position in which the Y-direction moving mechanism A is located as standing at the end of the working surface 2*a* in the X-direction and an inoperative position in which the Y-direction moving mechanism A is located as lying at the side of the working bed 2 at the end thereof in the X-direction as shown in FIG. 5(B).

The drive motor 18 is initiated to be driven in response to a position sensor (not shown) by way of example which detects the position of the slide member 11 when it comes to the end of the working surface 2*a* in the X-direction.

According to the invention as has been described hereinbefore, it will be apparent that the Y-direction moving mechanism A is operated to move the embroidering frame 19 in the X-direction while the X-direction moving mechanism B is operated to move the embroidering frame 19 in the Y-direction, thereby to move the embroidering frame 19 in the X-Y directions to carry out the embroidering operations. As to the X-Y directions described herein, the X-direction is designated to the width direction of sewing machine while the Y-direction is designated to the depth direction of sewing machine. It is, however, needless to say that the X-direction may be designated to the depth direction of sewing machine while the Y-direction may be designated to the width direction of sewing machine.

As shown in FIGS. 1(A) and 1(B), the working bed 2 has a pair of spaced guide grooves 2*d*, 2*d* formed thereat, the grooves being extended in parallel with each other from the working surface 2*a* to the side 25 of the working bed 2. The arms 5*b*, 5*b* of the Y-direction moving mechanism A are extended as passing through the guide grooves 2*d*, 2*d* respectively such that the arms 5*b*, 5*b* may be moved as guided by the guide grooves 2*d*, 2*d*, thereby to enable the Y-direction moving mechanism A to move in the X-direction on the working surface 2*a*.

The working bed 2 may be a one-body type and a separate type. The one-body type is such as the working bed 2 is assembled in one body with the arm 1 of sewing machine while the separate type is, as shown in FIG. 8, such as an auxiliary table 2*c*, in which the X- and Y-direction moving mechanisms are housed, is removably attached to the working bed 2 in which a thread loop catching mechanism and a work feeding mechanism for forming stitches are housed.

Figure 8:
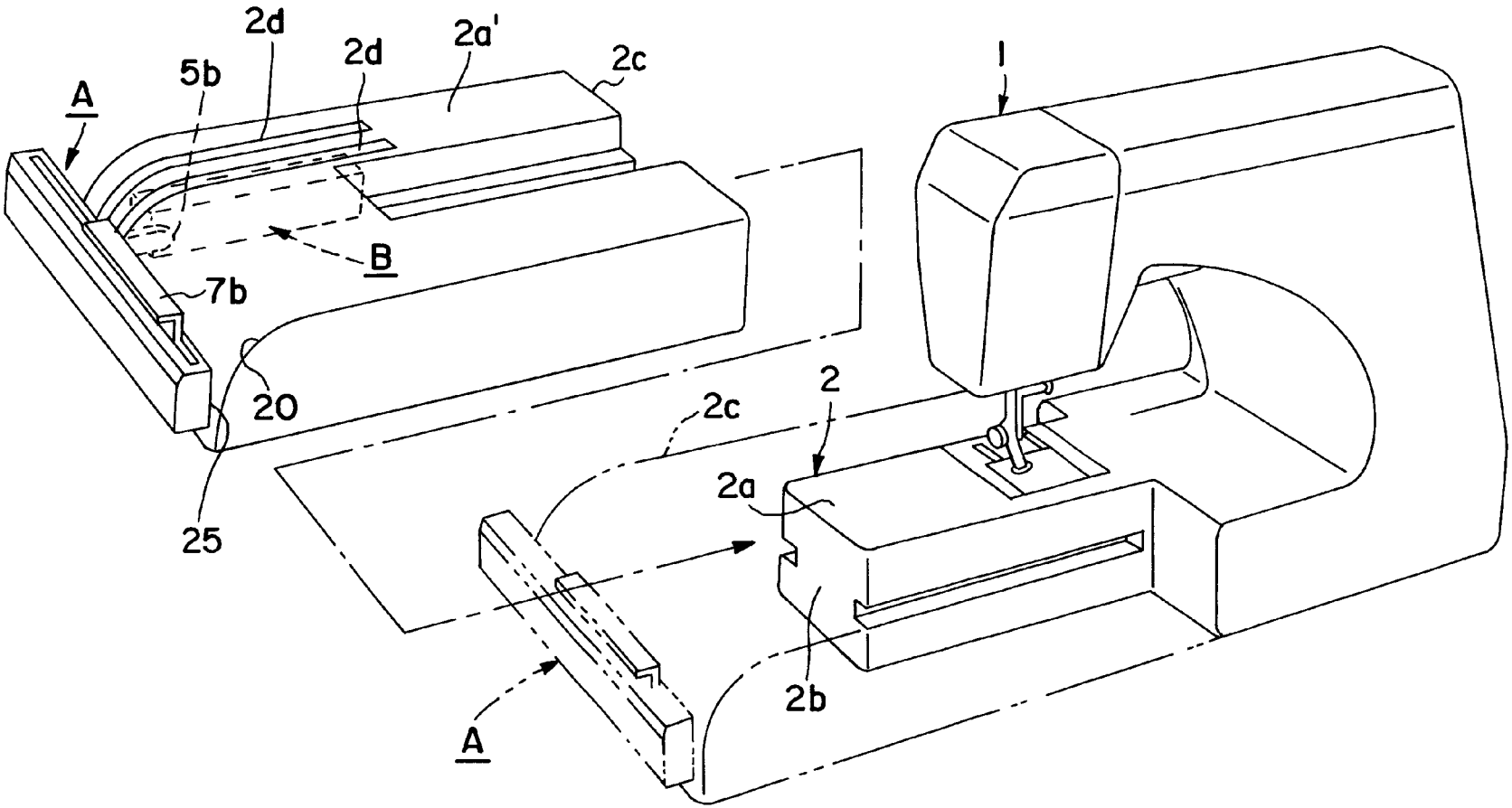
FIG. 8 is an exploded perspective view of another embodiment of working bed of the invention.

In FIG. 8, the auxiliary table 2*c* attached to the working bed 2 may be removed from the working bed 2 while a throat plate remains on the working bed 2. The auxiliary table 2*c* is of a generally U-shape in plan view. The working bed 2 heaving the auxiliary table 2*c* removed therefrom is a free arm bed 2*b* which is used for the ordinary stitching operation. The free arm bed 2*b* is of a generally ⊔ shape in plan view. The Y-direction moving mechanism A and the X-direction moving mechanism B are mounted to the auxiliary table 2*c* as mentioned hereinbefore. The structure for removably connecting the auxiliary table 2*c* to the working bed 2 may be optionally selected in various ways.

Figure 7A:
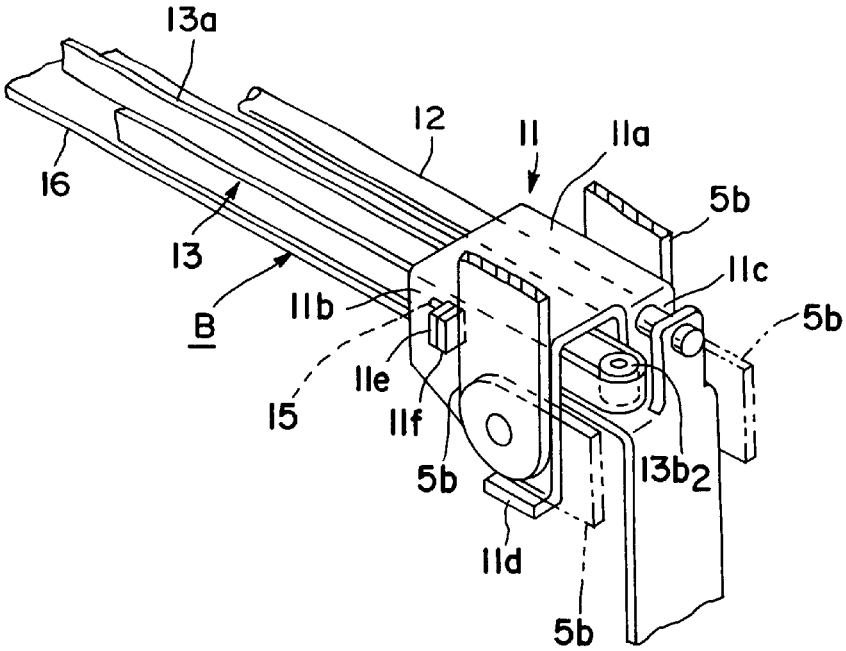
FIG. 7(A) is a perspective view of the essential parts of a second embodiment of carriage driver of the invention.
Figure 7B:
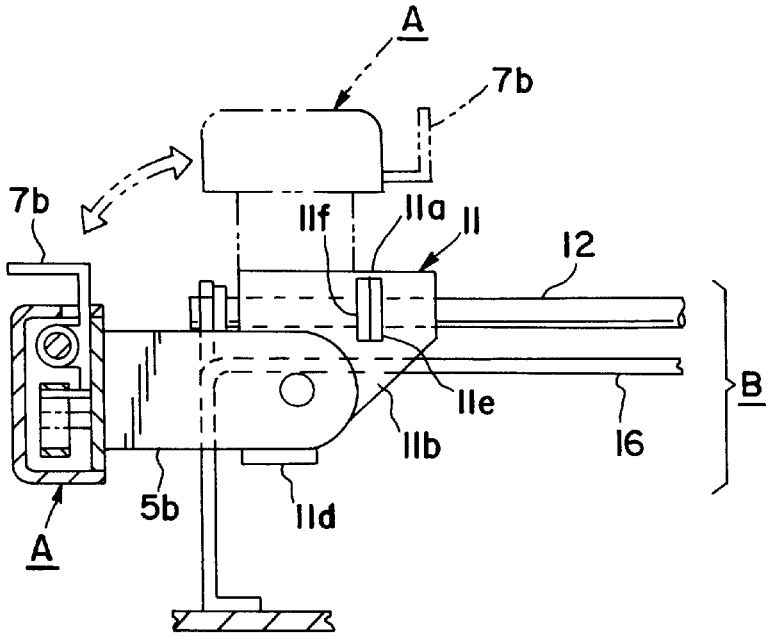
FIG. 7(B) is a side elevational view of FIG. 7(A) showing the operation of carriage driver.

FIGS. 7(A) and 7(B) show another embodiment of a mode for moving the Y-direction moving mechanism A from the operative position to the inoperative position. According to the embodiment, the Y-direction moving mechanism A is manually moved from the operative position to the inoperative position and vice versa. Precisely, the slide member 11 has a pair of stoppers 11*d*, 11*d* and another pair of stoppers 11*e*, 11*e* formed on both sides 11*b*, 11*b* thereof respectively. The stoppers 11*d*, 11*d* are provided to limit the rotation of the Y-direction moving mechanism A in the inoperative region while the stoppers 11*e*, 11*e* are provided to limit the rotation the Y-direction moving mechanism A in the operative region.

The rotation limiting stoppers 11*d*, 11*d* and 11*e*, 11*e* are provided with magnetic members 11*f* respectively such that the arms 5*b*, 5*b* of the Y-direction moving mechanism A may be fixedly held at the operative and inoperative positions respectively. The magnetic members may be metallic or rubber.

Though not particularly shown, in place of the stoppers 11*d*, 11*d* and 11*f*, 11*f*, projections and recesses may be provided at the slide member 11 and the arms 5*b* such that the projections and recesses may be brought into engagement with each other at the operative and inoperative position respectively, thereby to fixedly hold the Y-direction moving mechanism A at the operative and inoperative position respectively.

With operation for switching from the embroidering operation to the ordinary stitching operation, a signal is given to the drive motor 18 which is then driven to retreat the Y-direction moving mechanism A from the operative position to the inoperative position. In the case of the sewing machine wherein the auxiliary table 2*c* is removably attached to the sewing machine, various types of auxiliary tables may be prepared for stitching so many different embroidery patterns, thereby to enlarge the embroidering region of variations.

Thus according to the invention, in case the embroidery stitching operation is carried out, a selecting switch is operated to render the sewing machine to an embroidery stitching mode. The drive motor 18 is then driven to move the Y-direction moving mechanism A from the inoperative position at the side 25 of the working bed 2 to the operative position on the working surface 2*a*. The Y-direction moving mechanism A is operated to reciprocatingly move the embroidering frame 19 in the Y-direction while the X-direction moving mechanism B is operated to reciprocatingly move the embroidering frame 19 in the X-direction. With combination of the movements of X-and Y-direction moving mechanisms, the embroidery stitching operation may carried out.

On the other hand, in case the ordinary stitching operation is carried out, a selecting switch is operated to render the sewing machine to an ordinary stitching mode. The slide member 11 of the X-direction moving mechanism B is then operated to move the Y-direction moving mechanism A to the end of the working bed 2 in the X-direction. The drive motor 18 is then driven to rotatingly move the Y-direction moving mechanism A by way of the arms 5*b*, 5*b* from the operative position to the inoperative position at the side 25 of the working bed 2 as shown in FIGS. 5(A) and (B). Further, in case of the sewing machine of the type wherein the Y-direction moving mechanism A is manually moved, the Y-direction moving mechanism A is manually moved from the operative position on the working surface to the inoperative position at the side 25 of the working bed 2.

Further, according to the invention as described hereinbefore, the embroidery stitching operation may be carried out by positioning the Y-direction moving mechanism A on the working surface 2*a* and then by attaching the embroidering frame 19 to the Y-direction moving mechanism A. On the other hand, the ordinary stitching operation may be carried out by retreating the Y-direction moving mechanism A the inoperative position at the side of the working bed 2.

It is, therefore, possible to secure a broad working surface for the ordinary stitching operation as well as for the embroidery stitching operation. In any event, a large sized cloth or work may be easily dealt with for stitching. Further, at the time of carrying out the ordinary stitching, it is not required to remove the Y-direction moving mechanism A from the sewing machine. Therefore, the user is not required to take a troublesome work to attach or remove the Y-direction moving mechanism A to and from the sewing machine at the time of changing the stitching mode. Further there is no unstable elements in the mechanical structure which may otherwise exist in the conventional one.

What is claimed is:

1. A sewing machine with an embroidery stitching function provided with a needle vertically reciprocated to form stitches, a working bed having a working surface and an embroidering frame holding a work to be stitched, said sewing machine comprising a device located on the working surface and removably connected to the embroidering frame and operated to move the embroidering frame relative to the needle on the working surface and a means for retreating said frame moving device from said working surface to a position off of said working surface where said frame moving device is inoperative.

2. The sewing machine as defined in claim 1, wherein said retreating means is operated to retreat said frame moving device from said working surface to a side of said working bed.

3. The sewing machine as defined in claim 1, wherein said working bed is provided with a partly curved surface extending from said working surface to said side of said working bed such that said frame moving device may be retreated by said retreating means from said working surface to said side of said working bed as guided along said curved surface.

4. The sewing machine as defined in claim 1, wherein said retreating means is operated to retreat said frame moving device while said embroidering frame is connected thereto.

5. The sewing machine as defined in claim 1, wherein said retreating means is operated to retreat said frame moving device to a predetermined position where said frame moving device is located below the level of said working surface.

6. The sewing machine as defined in claim 1, wherein said retreating means is operated to rotate said frame moving device by 90° to retreat said frame moving device from said working surface to said inoperative position.

7. The sewing machine as defined in claim 1, wherein said frame moving device is composed of a first mechanism for moving said embroidering frame in one direction and a second mechanism for moving said embroidering frame in another direction which is normal to said one direction, one of said first and second mechanisms being located on said working surface and the other of said first and second mechanisms being housed in said sewing machine.

8. The sewing machine as defined in claim 1, wherein said working bed is composed of a free arm bed having a working surface and formed in one body with said sewing machine and an auxiliary bed having a working surface which may be removably connected to said free arm bed, and wherein said frame moving device and said retreating means are on said auxiliary bed.

9. The sewing machine as defined in claim 1, wherein said retreating means is operated in response to a signal produced at the time of changing an embroidery stitching mode to an ordinary stitching mode, thereby to retreat said frame moving device from said working surface to said inoperative position.

10. The sewing machine as defined in claim 1, wherein said frame moving device is composed of a first mechanism for moving said embroidering frame in one direction and a second mechanism for moving said embroidering frame in another direction which is normal to said one direction, one of said first and second mechanisms being located on said working surface and the other of said first and second mechanisms being housed in said sewing machine, and wherein said retreating means is connected to said one of said first and second mechanisms and is operated to rotate said one mechanism by 90° to retreat the same to said inoperative position after said one mechanism is moved to one end of said working bed by said other of said first and second mechanisms.

11. The sewing machine as defined in claim 10, wherein said one of said first and second mechanisms has arms pivotally connected to said other of said first and second mechanisms such that said one mechanism may be turnable relative to said other mechanism when said retreating means is operated.

12. The sewing machine as defined in claim 11, wherein said retreating means includes a drive motor which is initiated to be driven when said one of said first and second mechanisms comes near to one end of said working bed, thereby to rotate said arms thus to rotate said one mechanism relative to said other of said first and second mechanisms.

* * * * *